US012139865B2

(12) United States Patent
Smith

(10) Patent No.: US 12,139,865 B2
(45) Date of Patent: Nov. 12, 2024

(54) FLOATING BRUSH SWEEPER

(71) Applicant: Keith E. Smith, Kathleen, FL (US)

(72) Inventor: Keith E. Smith, Kathleen, FL (US)

( * ) Notice: Subject to any disclaimer, the term of this patent is extended or adjusted under 35 U.S.C. 154(b) by 296 days.

(21) Appl. No.: 17/128,064

(22) Filed: Dec. 19, 2020

(65) Prior Publication Data

US 2021/0108384 A1 Apr. 15, 2021

Related U.S. Application Data

(63) Continuation-in-part of application No. 14/867,135, filed on Sep. 28, 2015, now abandoned.

(60) Provisional application No. 62/056,997, filed on Sep. 29, 2014.

(51) Int. Cl.

| | |
|---|---|
| ***E01H 1/05*** | (2006.01) |
| ***A47L 11/283*** | (2006.01) |
| ***A47L 11/40*** | (2006.01) |

(52) U.S. Cl.

CPC ..... *E01H 1/056* (2013.01); *A47L 11/283* (2013.01); *A47L 11/4058* (2013.01)

(58) Field of Classification Search

CPC .. E01H 1/05; E01H 1/056; E01H 1/02; E01H 1/04; E01H 1/045; E01H 1/053; A46B 2200/3066; A46B 13/001; A46B 13/02; A47L 11/19; A47L 11/24

USPC ..... 15/78, 82, 49.1, 318, 345, 320, 319

See application file for complete search history.

(56) References Cited

U.S. PATENT DOCUMENTS

| | | | | |
|---|---|---|---|---|
| 4,643,261 | A * | 2/1987 | Long | E02F 3/845 15/82 |
| 4,785,715 | A * | 11/1988 | Bosniac | E01H 1/056 15/82 |
| 4,926,517 | A | 5/1990 | Smith | |
| 5,295,277 | A * | 3/1994 | Koenigs | E01H 1/0854 15/83 |
| 5,542,148 | A * | 8/1996 | Young | E01H 1/0872 15/82 |
| 6,006,390 | A * | 12/1999 | Bischel | E01H 1/00 15/82 |
| 6,354,081 | B1 * | 3/2002 | Burton | F15B 11/20 15/82 |
| 6,681,433 | B1 * | 1/2004 | Ruuska | E01H 1/056 15/82 |
| 7,428,767 | B2 | 9/2008 | Lougheed | |
| 9,045,872 | B2 * | 6/2015 | Wahl | E01H 1/02 |
| 9,783,942 | B1 * | 10/2017 | Stell | E01H 1/04 |
| 2009/0177329 | A1 * | 7/2009 | Alowonle | E01H 1/05 700/283 |

* cited by examiner

*Primary Examiner* — Robert F Neibaur

(74) *Attorney, Agent, or Firm* — Terry M. Sanks, Esq.; Beusse Sanks, PLLC

(57) ABSTRACT

This invention relates to an industrial street sweeper and especially to a street sweeper having a floating sweeper brush which floats or rides over obstacles in the surface being cleaned.

14 Claims, 4 Drawing Sheets

FLOATING BRUSH SWEEPER

This application claims the benefit of U.S. patent application Ser. No. 14/867,135 filed Sep. 28, 2015 for FLOATING BRUSH SWEEPER which claims the benefit of provisional application Ser. No. 62/056,997, filed Sep. 29, 2014 for FLOATING BRUSH SWEEPER.

FIELD OF THE INVENTION

This invention relates to an industrial street sweeper and especially to a street sweeper having a floating sweeper brush which raises and lowers the sweeper brush frame and the rotating sweeper brush over surface obstacles on the surface being swept.

BACKGROUND OF THE INVENTION

Industrial sweepers used in cleaning streets and the like have a rotating brush mounted to the front or rear of a motorized vehicle. An electric or hydraulic motor drives the rotating brush or brushes along the surface of the area being cleaned sweeping material into a bucket. The brush is controlled from the vehicle's cab with hydraulic or electric controls. The brush of the sweeper needs to be mounted in a position to sweep the area being traversed for cleaning the surface. The invention uses a pair of hydraulic cylinders which are used to raise and lower the sweeper brush and to float the brush along the surface of the area being swept to vary the force of the sweeper brush on the surface.

Prior art can be seen in my prior patent for a sweeper, U.S. Pat. No. 4,926,517 (to Smith) for a sweeper support structure having movable arms holding the brush which can be moved apart to allow a brush held between the arms to be replaced. It also provides a raising and lowering mechanism using a parallelogram having a single hydraulic cylinder in the center for raising and lowering the sweeper and provides for a stop element mounted to the hydraulic cylinder to provide a minimum height for the sweeper.

US Patent Application No. 2009/0177329 to Alowonle et al. teaches a hydraulic control scheme for a surface maintenance machine that uses a pressure sensor to read the hydraulic pressure in the rotatable driver and sends an electric signal to a controller circuit. The controller circuit also receives a signal from a manual input circuit selecting, high, medium, or low pad pressure. The controller circuit then generates a pulse width modulation signal to activate an electric solenoid valve to control a hydraulic actuator to set a rotatable driver pad.

U.S. Pat. No. 7,428,767 to Lougheed is for a sweeper which has a floating brush or drum assembly. The sweeper has a rotating brush or drum supported by a float arm movably coupled to the sweeper bucket. The float arm is coupled to a linkage to movably support the float arm between a retracted position and a forward position. The float arm is rotationally coupled to the linkage to compensate for height variations and provide a mechanism to rotate the linkage to move the float arm forward relative to the debris collection bucket.

The present invention is for an improved sweeper brush and lift mechanism using a pair of parallel hydraulic cylinders operating in conjunction with a mechanical linkage supporting the sweeper brush. The sweeper brush frame and sweeper brush float over obstacles on the surface being swept.

SUMMARY OF THE INVENTION

This invention relates to an industrial street sweeper and especially to a street sweeper having a floating sweeper brush which varies the rotating brush up and down on a surface being swept to float the brush over obstacles in the surface being cleaned.

A floating sweeper brush attachment for a wheeled vehicle has a sweeper brush frame rotatably supporting a sweeper brush. The sweeper brush frame has a hydraulic brush motor mounting thereon for rotating the sweeper brush on the frame. A linkage is attached between a front plate attached to the sweeper brush frame and a rear support plate attached to a wheeled vehicle to moveably support the sweeper brush frame and sweeper brush to the wheeled vehicle. A lift hydraulic cylinder is attached between the sweeper brush front plate and the rear support plate for raising and lowering the sweeper brush frame responsive to actuation of the lift hydraulic cylinder. The lift hydraulic cylinder has a neutral non-sweeping brush frame supporting position. A floating hydraulic cylinder is attached between the sweeper brush front plate and the rear support plate parallel to the lift hydraulic cylinder for supporting the sweeper brush frame when the lift hydraulic cylinder is in a neutral position and moves the sweeper brush frame and sweeper brush responsive to actuation of the floating hydraulic cylinder. A hydraulic fluid line is operatively connected from a variable hydraulic pump to both the sweeper brush frame hydraulic brush motor and to the floating hydraulic cylinder to vary the hydraulic pressure in the floating hydraulic cylinder by variations in the hydraulic pressure caused by the sweeper brush frame hydraulic brush motor when the lift hydraulic cylinder is in a neutral position responsive to the contact force of the sweeper brush on a surface being cleaned. The hydraulic fluid pressure is operatively coupled through hydraulic lines to both the hydraulic brush motor and the floating hydraulic cylinder. The hydraulic pressure generated within the system varies based on a variety of factors by diverting the hydraulic brush pressure to a pacific bore diameter cylinder so that the desired contact of the brush to the surface being cleaned can be obtained. This allows the brush to be floated over extremely unlevel surfaces through out the range of the lifting assembly. The sweeper brush is thus raised and lowered over surface obstacles on a surface being cleaned responsive to hydraulic pressure in the sweeper brush motor.

BRIEF DESCRIPTION OF THE DRAWINGS

The accompanying drawings, which are included to provide further understanding of the invention, are incorporated in and constitute a part of the specification and illustrate an embodiment of the invention and, together with the description, serve to explain the principles of the invention.

DETAILED DESCRIPTION OF EXEMPLARY EMBODIMENT

Figure 1:
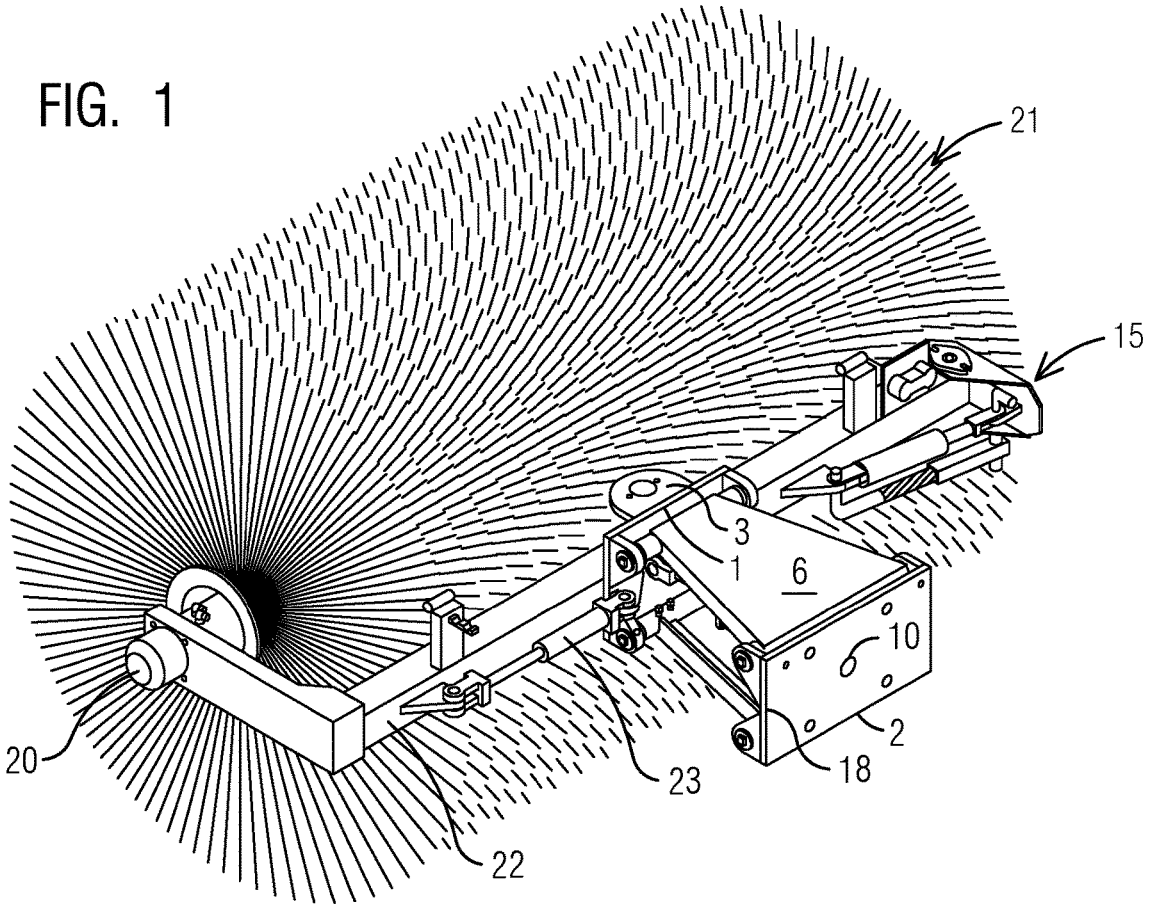
FIG. 1 is a perspective view of a floating brush sweeper attachment in accordance with the present invention.

In this description of the present invention in FIGS. 1 through 5, the following list of components are identified with the adjacent numerals as follows:

1. Front Plate
2. Rear Plate
3. Pivot Plate Upper
4. Lift Plate Pins
5. Lift Plate Yoke Ears
6. Upper Lift Plate
7. Lower Lift Plate
8. Lift Cylinder
9. Float Cylinder
10. Alignment Pin
11. Front Plate Parallel Cylinder Gussets
12. Cylinder Pins
13. Lower Pivot Plate
15. Complete Lift Assembly
16. Rear Yoke Cylinder Parallel Gussets
17. Front Yoke Assembly
18. rear Yoke Assembly
19. Lift Cylinder Valve
20. Brush Motor
21. Brush
22. Brush Frame
23. Pivot hydraulic cylinder
24. Lift cylinder hydraulic fluid reservoir
25. Floating cylinder hydraulic fluid reservoir
26. Lift cylinder hydraulic fluid pump
27. Floating cylinder brush motor hydraulic fluid pump
28. Flow control valve
29. Quick change cylinder
30. Quick change valve
31. Brush motor valve
32. Wheeled vehicle The present invention is for an industrial sweeper machine as shown in FIGS. 1 and 2 which uses a hydraulic system to control the downward force of the sweeper brush onto the surface being swept to allow the brush to ride over obstacles in the surface being sweep.

Figure 2:
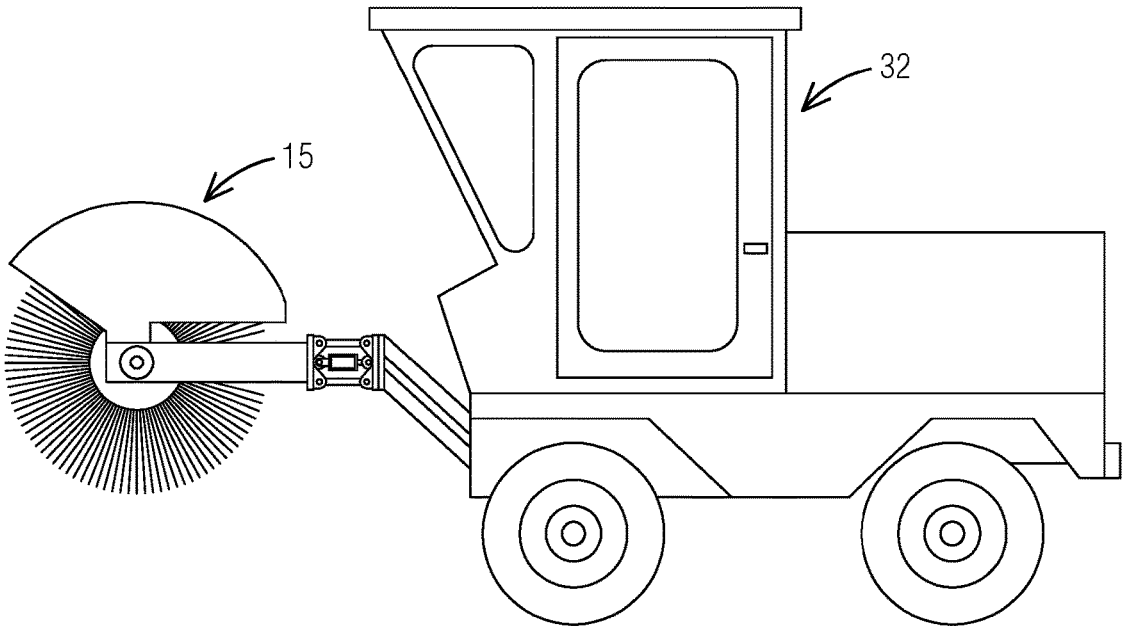
FIG. 2 is a side elevation of a brush sweeper attachment attached to a wheeled vehicle.
Figure 3:
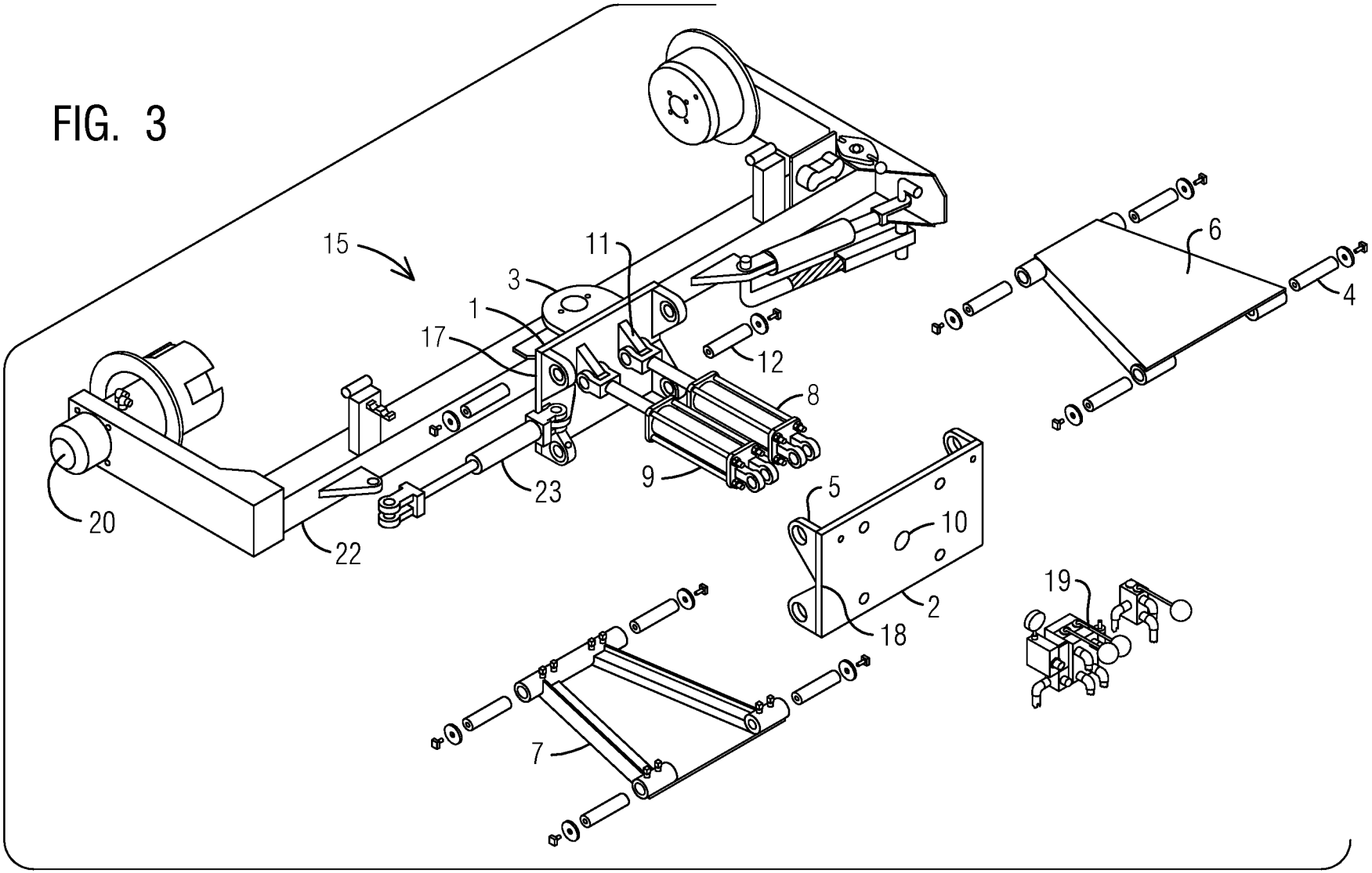
FIG. 3 is an exploded perspective view of the floating brush sweeper attachment of FIG. 1.
Figure 4:
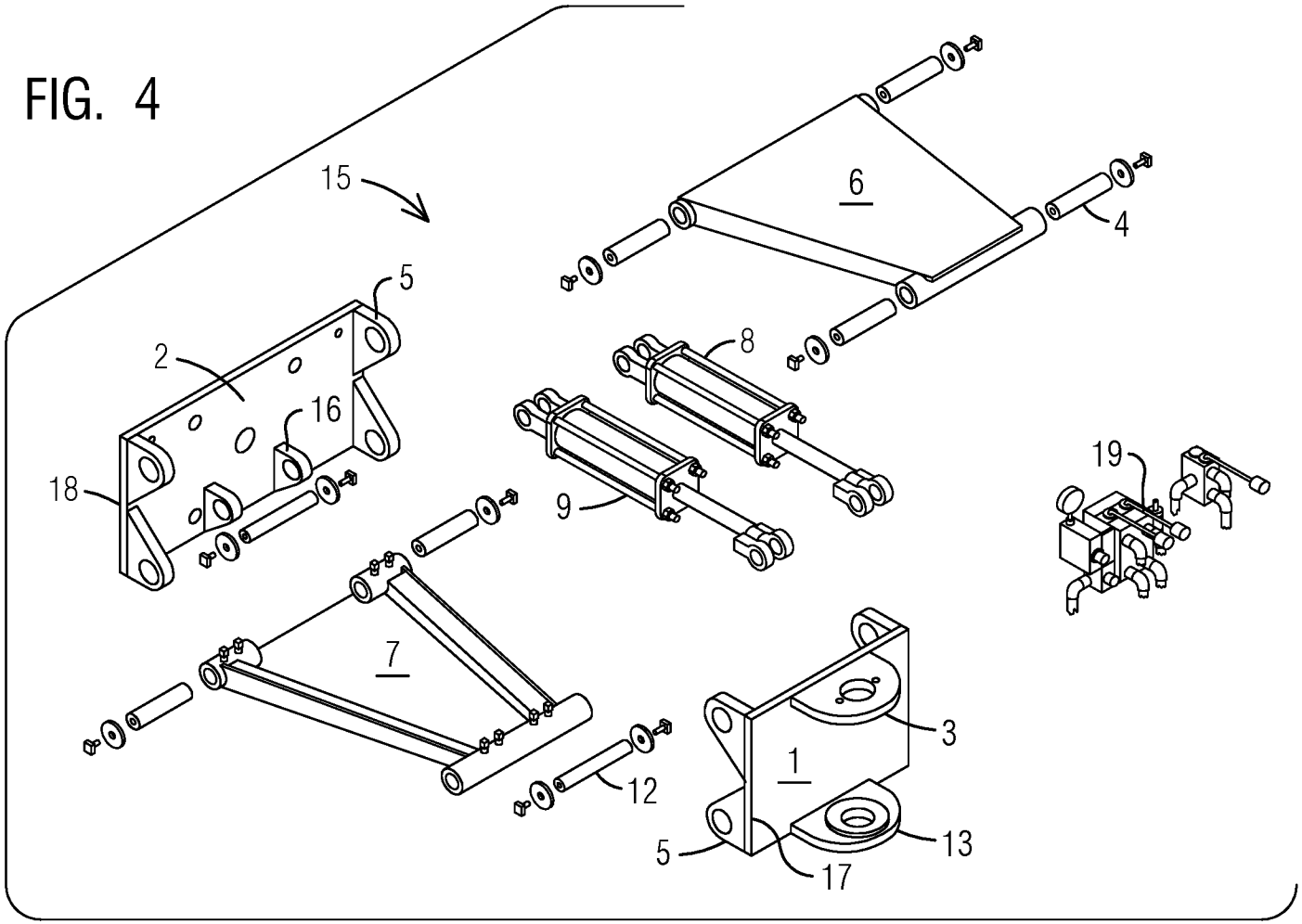
FIG. 4 is an exploded perspective view of the floating brush sweeper attachment floating linkage of FIGS. 1 and 3.

The system as shown in the drawings, FIGS. 1 through 5, and especially as seen in FIGS. 1, 3 and 4, uses a lift assembly 15 attached to a wheeled vehicle 32 having a forward assembly called a front yoke. This front yoke assembly 17 includes a main plate having an upper and lower pivot plate 3 and 13 attached to the main plate by welding. The main plate also has two cylinder gussets attached thereto by welding and has four lift plate ears 5 attached thereto by welding.

The present system includes a lift assembly which includes a rear main plate 2 that has two cylinder gussets 16 to receive the parallel cylinders 8 and 9, and four lift plate ears 5 attached to the rear plate 2 by welding. A center leveling alignment pin 10 allows the rear plate 2 to rotate with respect to a mount plate allowing for a means to level the brush. The rear plate 2 and the mount or front plate 1 have means to bolt the lift plates 6 and 7 to secure the positioning between the rear yoke plate 18 and the front plate 1.

The front plate 1 and the rear plate 2 are held in the vertical arrangement of an upper lift plate 6 and a lower lift plate 7. The upper and lower plates 6 and 7 are attached to the front and rear plate by pins 4 that hold the upper and lower plates 6 and 7 in position in a parallel arrangement. The parallel cylinders 8 & 9 are attached to the front and rear yoke plates 17 and 18 with pins 12 that locate the cylinders in a parallel configuration. When hydraulic fluid pressure is applied to the lift cylinder, the lift assembly 15 changes its configuration to lower or lift the assembly. When the lift cylinder 8 is placed in a neutral position by means of a hydraulic valve, the lift cylinder 8 no longer controls the lift assembly 15 position and the float cylinder 9 controls the position of the lift assembly 15. Hydraulic fluid pressure is applied to the float cylinder 9 by a variable hydraulic fluid pump 27 which also supplies the brush motor 20. A hydraulic driven brush motor 20 drives the sweeper brush 21 which is supported on the brush frame.

When the brush contacts the surface being swept, hydraulic fluid pressure is diverted into the float cylinder 9 allowing for a constant source of flowing fluid to maintain a constant brush 21 contact pressure with an area being swept. The fluid pressure supplied by the brush motor 20 is a variable pressure supply of fluid so that when the brush 21 contacting the surface increases due to a rise in the surface being swept, the pressurized fluid is applied to the float cylinder 9. As the float cylinder 9 raises the lift assembly 15, which raises the brush 21, the fluid pressure is decreased to the float cylinder 9 and as the brush 21 rises, the pressure is reduced. When the brush 21 loses contact pressure with the surface being swept, the float cylinder 9 collapses to allow the brush 21 to settle down.

As can be seen from the drawings, a lift assembly 15 is used to control the up and down motion and the left to right swing motion of a brush frame 22 to move the position of the brush 21. This gives the brush 21 the ability to float over the area being swept and over obstacles and to control the contact pressure against the surface being swept.

A complete lift assembly 15 has a front yoke plate 1, which has means for a brush frame 22 to mount thereto with upper and lower pivot plates 3 and 13. The means to attach the upper lift plate 6 and a lower lift plate 7 is accomplished by the use of four lift plate yoke ears 5. The ears 5 are welded in place and have means to accept a spherical bearing. A pivot hydraulic cylinder 23 pivots the brush frame 15.

The lift cylinder 8 and the float cylinder 9 are welded in a precise location to a pair of cylinder gussets 11. The gussets 11 are positioned on front plate 1 in a precise location above the center line of front plate to accept the lift cylinder 8 and float cylinder 9. Cylinder pins 12 secure cylinders 8 and 9 in place.

The complete parallel lift assembly 15 has a rear yoke assembly 18 having a rear yoke plate 2 that has four lift plate yoke ears 5 and a pair of cylinder gussets to mount cylinders 8 and 9. The rear yoke cylinder parallel gussets 16 are welded to the rear yoke plate 2 positioned below the center position on rear plate 2. The rear yoke cylinder parallel gusset 16 is welded below the center position on plate 2. This position of the front plate parallel cylinder gussets 11 and rear yoke cylinder parallel gussets 16 provide the means for the complete lift assembly 15 to raise and lower the brush frame with lift cylinder 8.

Lift cylinder 8 is necessary for an operator to be able to lift and lower the brush frame 22 with the complete lift assembly 15 since lift cylinder 8 extends the configuration of the complete lift assembly 15 and raises the front plate 1 above the rear yoke assembly 18. As lift cylinder 8 is retracted, the front yoke assembly 17 is lowered in relation to the rear yoke assembly 18.

Control of the force applied by the brush to the surface being cleaned is done by means of the float cylinder 9. Float cylinder 9 is mounted parallel to lift cylinder 8 by means of rear yoke cylinder gusset 16 and front plate cylinder gusset 11 which are held in place by cylinder pins 12.

Floating the brush hydraulically is done with a supply of hydraulic fluid that is variable in flow rate and variable in fluid pressure. Changing the flow rate and pressure is necessary to maintain an even contact force between the brush 21 and the surface being swept. As the sweeping machine maneuvers over an uneven surface, the brush contact force varies thereby producing either more or less fluid pressure in the brush motor supply line. When the pressure of the brush 21 against the surface being cleaned increases, the hydraulic fluid pressure increases proportionally in the float cylinder 9 to raise the brush 21 and as the hydraulic fluid pressure decreases by the brush 21 having less contact with the surface being swept, the hydraulic fluid flows back out of the cylinder 9 allowing the brush to settle onto the surface being cleaned.

The variable flow and pressure of the hydraulic fluid in the hydraulic pressure line feeds the brush motor 20 and the float cylinder 9 from the reservoir 25 and pump 27. The pressure generated within the hydraulic system varies is based on a variety of factors including the density of the brush, weight of the brush, speed of the brush, diameter of the brush, the surface being swept and the amount of debris being swept. The hydraulic pressure varies due to all these factors by diverting the hydraulic brush pressure to the pacific bore diameter cylinder so that the desired contact of the brush to the surface can be obtained. This is why the brush can be floated over extremely unlevel surfaces through out the range of the lifting assembly.

The floating action would not be possible without the variable pressurized hydraulic fluid generated by the variable hydraulic pump 27 varying the hydraulic fluid pressure of the demands of the brush motor 20. This requires the placement of lift cylinder 8 in a neutral position, not supporting the brush frame, so that the variable floating action of float cylinder 9 can take place to float the brush over the surface being swept.

The lift cylinder valve 19 has multiple positions which allows the float cylinder 9 to function. The lift cylinder valve 19 has a lift, blocked neutral, down and float or neutral positions. When the lift cylinder valve 19 is in its float or neutral position, the hydraulic fluid is allowed to be cycled in and out of a fluid reservoir 24 by the pump and by the action of the lift cylinder 8 while the float cylinder 9 supports the sweeper brush frame and sweeper brush. The sweeper brush frame position is varied by the variable forces being applied to the float cylinder 9 by means of the hydraulic fluid pressure from the variable hydraulic fluid pump 27 operating the brush motor 20. When the operator wants to lift the lift assembly 15, the lift cylinder valve 19 directs the hydraulic fluid to the lift cylinder 8. When the operator wants to lower the lift assembly 15, the lift cylinder valve 19 is directed to a down position. When the operator wants to hold the lift assembly 15 in a suspended position or in a forced down position, the operator positions cylinder valve 19 in a blocked neutral position. This block position of cylinder valve 19 overrides any pressure that is directed to the float cylinder 9. A valve with a detent float position is used to allow the lift cylinder 8 to be in a position that allows it to move freely allowing the float cylinder 9 to function when cylinder valve 19 is in a detent position to raise or hold the lift assembly 15 in a certain position or to lower the lift assembly 15. The act of raising or lowering or even holding the lift assembly 15 in a fixed position is not affected by any force that may be applied to float cylinder 9.

Figure 5:
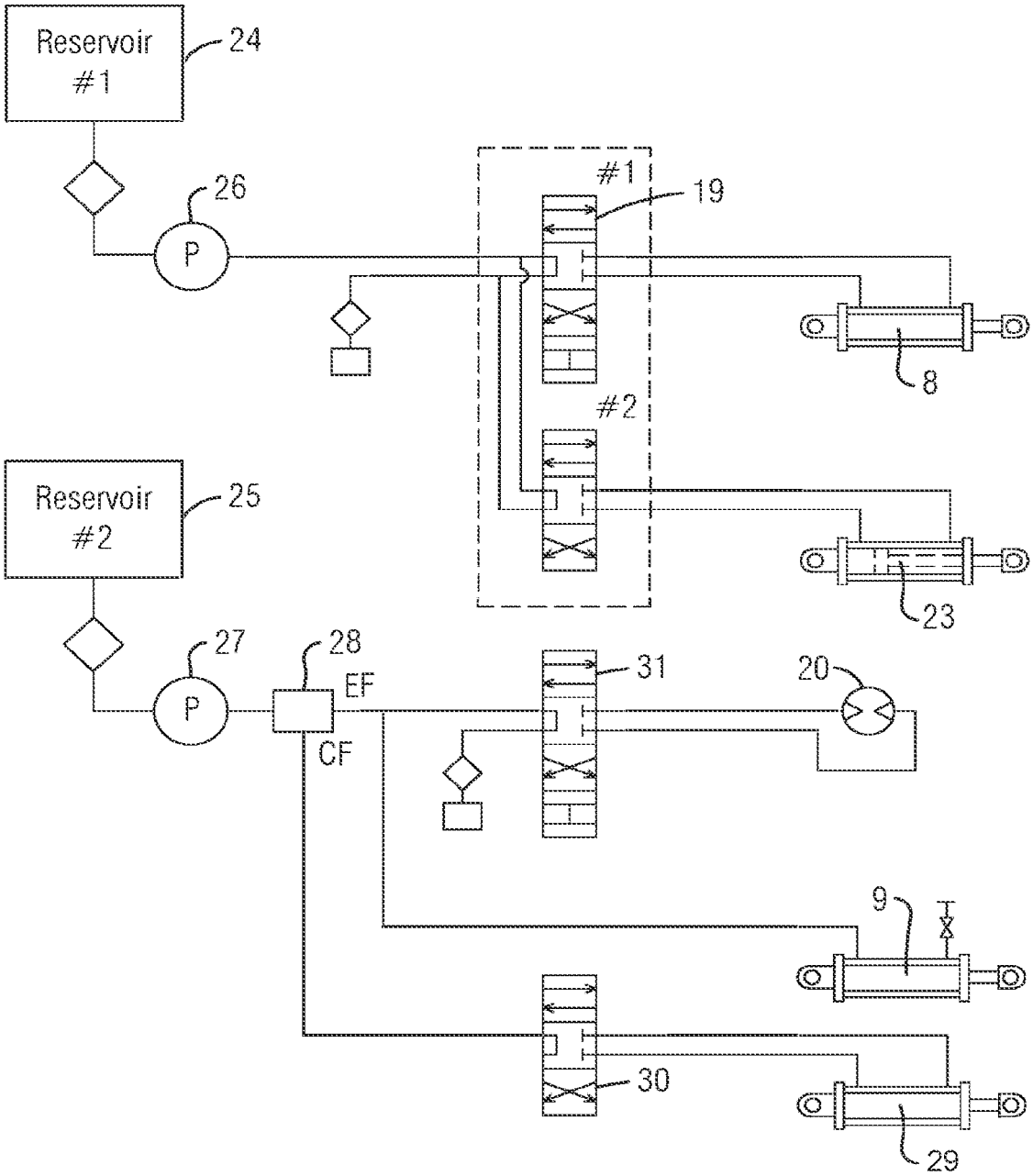
FIG. 5 is a diagrammatic flow diagram for the hydraulics of the floating brush sweeper in accordance with the present invention.

As seen in FIG. 5, the improved float system is accomplished with the lift cylinder 8 and the float cylinder 9 operating with hydraulic fluid from two different sources. Lift cylinder 8 receives hydraulic fluid from the prime movers lift cylinder valve 19. The float cylinder 9 receives its hydraulic fluid from the reservoir 25 and variable hydraulic fluid pump 27 supplying both the brush motor 20 and the float cylinder 9. A flow control valve 28 controls the flow from the reservoir 25 and pump 27 to the quick change cylinder 29 through the quick change valve 31.

The improved brush float system can function with two sources of hydraulic fluid such as a tractor that uses its own hydraulic fluid and lift valve, and an assembly or attachment such as a sweeper that would use a separate source of hydraulic fluid to supply the brush motor 20 to provide a variable supply of hydraulic fluid to the float cylinder 9.

It should be clear at this time that a floating brush system for a street sweeping machine has been provided which varies the brush pressure on the surface being swept as the surface being swept varies. However the present invention is not to be considered limited to the forms shown which are to be considered illustrative rather than restrictive.

I claim:

1. A floating sweeper brush attachment for a wheeled vehicle comprising:

a sweeper brush;

a sweeper brush frame rotatably supporting the sweeper brush, the sweeper brush frame having a hydraulic brush motor mounted thereon for rotating the sweeper brush on the frame;

a linkage attached between a front plate attached to the sweeper brush frame and a rear support plate attached to the wheeled vehicle to moveably support the sweeper brush frame and the sweeper brush to the wheeled vehicle;

a lift assembly including a lift hydraulic cylinder attached between the front plate and the rear support plate, the lift assembly causes raising and lowering of the sweeper brush frame responsive to actuation of the lift hydraulic cylinder, the lift hydraulic cylinder having a neutral position;

a floating hydraulic cylinder attached to the lift assembly between the front plate and the rear support plate parallel to the lift hydraulic cylinder and which controls a position of the lift assembly when the lift hydraulic cylinder is in the neutral position wherein when the sweeper brush contacts the surface being swept, hydraulic fluid pressure is diverted into the float cylinder allowing for a constant source of flowing fluid to maintain a constant brush contact pressure between the sweeper brush and the surface being swept; and a variable hydraulic fluid source operatively connected to the hydraulic brush motor to the floating hydraulic cylinder to vary the hydraulic fluid pressure in the floating hydraulic cylinder by variable hydraulic pressure in the hydraulic brush motor, wherein when the lift hydraulic cylinder is in the neutral position, responsive to a force of the sweeper brush on the surface being swept, the hydraulic fluid pressure increases proportionally in the float hydraulic cylinder, which causes the lift assembly to cause the brush frame to raise the sweeper brush when the sweeper brush sweeps over a raised surface obstacle and the hydraulic fluid pressure decreases in response to the sweeper brush having less contact with the surface being swept, which causes the hydraulic fluid to flow back out of the float hydraulic cylinder allowing the sweeper brush to settle onto the surface being swept.

2. The floating sweeper brush attachment in accordance with claim 1, wherein the variable fluid source includes a hydraulic fluid reservoir and a float hydraulic cylinder pump supplying the float hydraulic cylinder and the hydraulic brush motor.

3. The floating sweeper brush attachment in accordance with claim 2, further comprising a lift hydraulic fluid reservoir and a lift hydraulic cylinder pump supplying the lift hydraulic cylinder.

4. The floating sweeper brush attachment in accordance with claim 1, wherein the lift hydraulic cylinder is manually remotely controlled to raise or lower the sweeper brush frame and the sweeper brush.

5. The floating sweeper brush attachment in accordance with claim 4, wherein the linkage has a frame lift plate movably attached between the front plate and the rear support plate movably supporting the sweeper brush frame to the rear support plate.

6. The floating sweeper brush attachment in accordance with claim 1, wherein the linkage has two frame lift plates movably attached between the front plate and the rear support plate movably supporting the sweeper brush frame to the rear support plate.

7. The floating sweeper brush attachment in accordance with claim 6, wherein the linkage has a frame lift plate movably attached to the sweeper brush frame on one end and movably attached to the rear support plate on another end thereof.

8. A floating sweeper brush attachment comprising:

a sweeper brush;

a sweeper brush frame rotatably supporting the sweeper brush, the sweeper brush frame having a hydraulic brush motor mounted thereon for rotating the sweeper brush on the sweeper brush frame, the sweeper brush frame raises and lowers the sweeper brush over surface obstacles on a surface being swept responsive to hydraulic fluid pressure in the hydraulic brush motor as a force of the sweeper brush varies against the surface obstacles of the surface being swept;

a lift assembly that includes a pair of hydraulic cylinders mounted parallel to each other, a front support plate coupled to the sweeper brush frame and a rear support plate coupled to a wheeled vehicle, the pair of hydraulic cylinders includes:

a float hydraulic cylinder coupled to and between the front and rear support plates, and a lift hydraulic cylinder coupled to and between the front and rear support plates, the lift hydraulic cylinder having a neutral position for disengaging the sweeper brush frame to allow the float hydraulic cylinder to control the sweeper brush frame and sweeper brush; and a variable hydraulic source fluid line operatively connecting the hydraulic brush motor to the float hydraulic cylinder together to vary the hydraulic fluid pressure in the float hydraulic cylinder responsive to changes in hydraulic pressure in the hydraulic brush motor and responding to variations in the force of the sweeper brush sweeping the surface, wherein the hydraulic fluid pressure increases proportionally in the float hydraulic cylinder, which causes the brush frame to raise the sweeper brush, when the sweeper brush sweeps over a raised surface obstacle, and the hydraulic fluid pressure in the hydraulic brush motor decreases in response to the sweeper brush having less contact with the surface being swept, which causes the hydraulic fluid to flow back out of the float hydraulic cylinder to cause the sweeper brush frame to settle the sweeper brush onto the surface being swept.

9. The floating sweeper brush attachment in accordance with claim 8, further comprising a variable fluid source that includes a hydraulic fluid reservoir and float hydraulic cylinder pump supplying the float hydraulic cylinder and the hydraulic brush motor.

10. The floating sweeper brush attachment in accordance with claim 9, further comprising a lift hydraulic fluid reservoir and a lift hydraulic cylinder pump supplying the lift hydraulic cylinder.

11. The floating sweeper brush attachment in accordance with claim 8, wherein the lift hydraulic cylinder is manually remotely controlled to raise or lower the sweeper brush frame and the sweeper brush.

12. The floating sweeper brush attachment in accordance with claim 8, further comprising:

a linkage attached between the sweeper brush frame and a frame supporting plate to movably support the sweeper brush frame to the frame supporting plate, wherein the sweeper brush frame has a linkage connecting plate pivotally supporting the sweeper brush frame to one end of the linkage.

13. The floating sweeper brush attachment in accordance with claim 12, wherein the lift hydraulic cylinder connects the linkage connecting plate to the sweeper brush frame for pivoting the sweeper brush frame thereon.

14. The floating sweeper brush attachment in accordance with claim 12, wherein the linkage has a frame lift plate movably attached to the sweeper brush frame on one end and movably attached to the frame supporting plate on another end thereof.

* * * * *